United States Patent [19]

Maxey

[11] 4,234,819

[45] Nov. 18, 1980

[54] UNDERWATER LIGHT CIRCUIT AND INSTALLATION

[75] Inventor: Eugene R. Maxey, Valinda, Calif.

[73] Assignee: Purex Corporation, Lakewood, Calif.

[21] Appl. No.: 48,548

[22] Filed: Jun. 14, 1979

[51] Int. Cl.[3] ..... H05B 39/04; F21V 31/00

[52] U.S. Cl. ..... 315/119; 200/61.04; 307/118; 362/276; 362/802

[58] Field of Search ..... 315/119, 288; 307/118; 340/618, 620; 328/7; 200/61.04; 362/22, 145, 147, 267, 276, 295, 802

[56] References Cited

U.S. PATENT DOCUMENTS

| | | | |
|---|---|---|---|
| 3,407,337 | 10/1968 | Benham | 328/7 X |
| 3,440,396 | 4/1969 | Greene | 200/61.04 X |
| 3,732,556 | 3/1973 | Caprillo | 200/61.04 X |
| 3,914,592 | 10/1975 | Maxey | 362/362 |
| 3,944,845 | 3/1976 | Luteran | 307/118 |

*Primary Examiner*—Eugene R. LaRoche
*Attorney, Agent, or Firm*—William W. Haefliger

[57] ABSTRACT

An underwater light circuit employs electrodes exposed to water, a light, and circuitry connected with the electrodes and light filament to control current flow to the filament.

9 Claims, 3 Drawing Figures

UNDERWATER LIGHT CIRCUIT AND INSTALLATION

BACKGROUND OF THE INVENTION

This invention relates generally to underwater lights, and more particularly concerns improvements in swimming pool light safety features.

U.S. Pat. No. 3,914,592 describes an underwater light which automatically turns off when pool water drains out of contact with two electrodes exposed to the water. While that light has many advantages, a problem can arise with the described circuit; for example, current flow in the common line can cause a voltage drop which in turn can cause excessive current flow through the water between electrodes exposed to the water. As a result, a GFI connected in the circuit can trip, shutting off the light.

SUMMARY OF THE INVENTION

It is a major object of the invention to provide an improved underwater light control circuit characterized as overcoming problems as referred to above, and also providing a somewhat simpler circuit. Basically, the underwater light circuit is embodied in the following combination:

(a) first and second terminals across which AC power is applicable, and a ground connection, (b) a pair of electrodes exposed for contact with the water, one electrode electrically connected with the first of said terminals, and the other electrode connected with said ground connection, (c) a network including resistance and capacitance connected in series between said one electrode and said first terminal, (d) an electric lamp having a filament, and a first gate controlled switch connected in series with the filament between said first and second terminals, (e) said network electrically connected with the gate of said first switch to effect turn-on of said first switch in response to predetermined charging of said capacitance to predetermined voltage level, (f) and a second gate controlled switch connected in series with said network, said one electrode connected with the gate of said second switch to effect turn-on of said second switch when current passes between said electrodes, thereby to effect current flow between said terminals and charging of said capacitance to said voltage level.

As will be seen, the two switches may comprise triacs; the network may include by-pass resistance functioning as will be made clear; and current limiting capacitance is employed in series with one of the electrodes. As a result, the temperature responsive resistance element of the circuit in U.S. Pat. No. 3,914,592 is eliminated, as is the need for electrode 12 described in that patent, and safety and reliability are enhanced.

These and other objects and advantages of the invention, as well as the details of an illustrated embodiment, will be more fully understood from the following description and drawings, in which:

DRAWING DESCRIPTION

DETAILED DESCRIPTION

Figure 1:
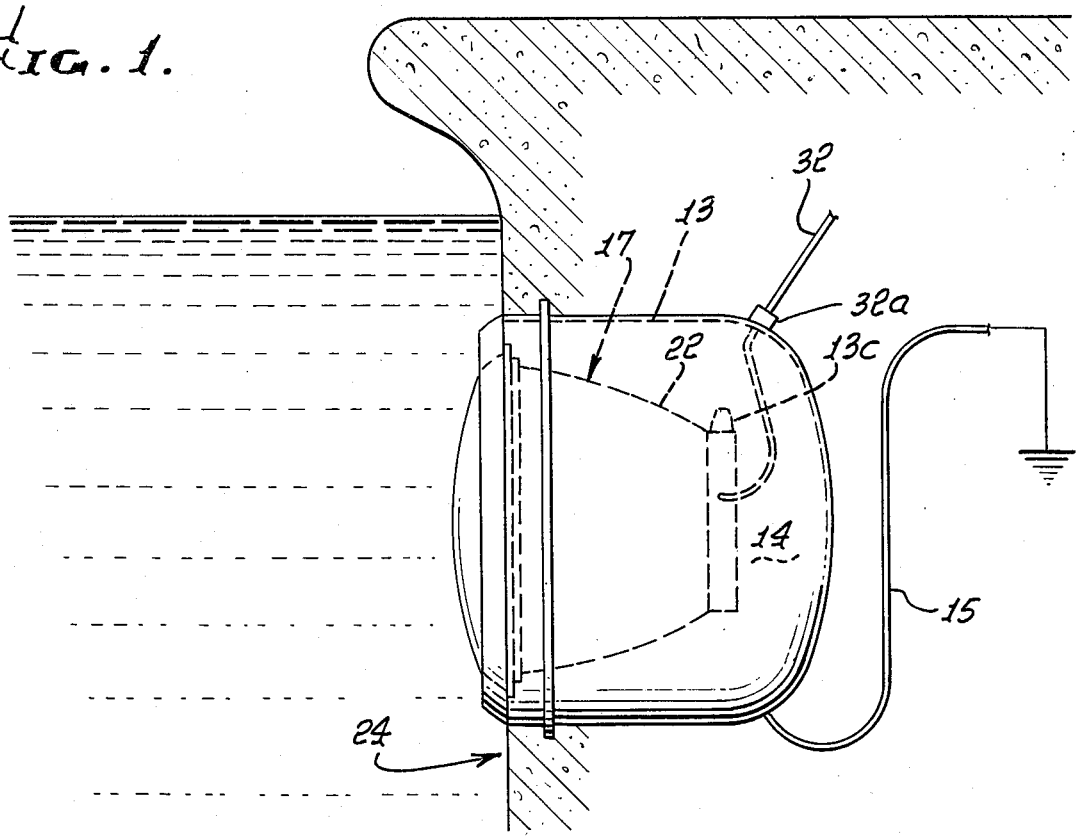
FIG. 1 is an elevational view showing an underwater light circuit incorporating the invention.
Figure 3:
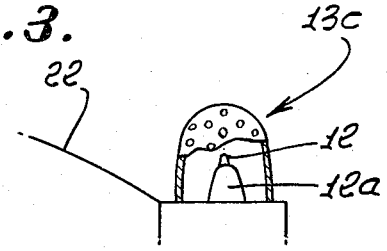
FIG. 3 is an enlarged view of electrodes and associated structure.
Figure 2:
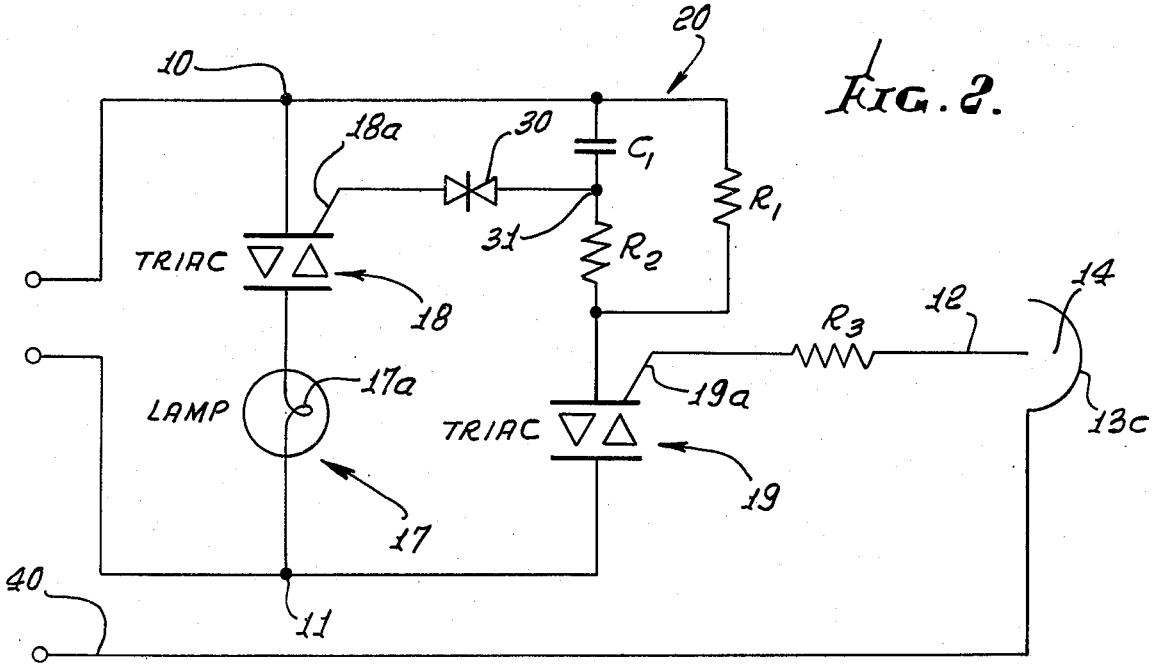
FIG. 2 is a circuit diagram.

Referring first to FIG. 2, the light circuit includes first and second terminals, as for example at 10 and 11 across which electrical power is applied (such as 115 VAC). A pair of metallic electrodes, as at 12 and **13*c*, is exposed for contact with the water, these electrodes also appearing in FIG. 1. Water fills the space 14 in FIG. 1, to which the electrodes are exposed. Electrode 12 is electrically connected with the first terminal 10, and electrode 13*c* is connected with a ground connection 40. Point 11 represents a common connection. Electrode 12 is carried by an insulator 12*a* which also seals off against water entry into lamp housing 22. Electrode 13*c* is shown in FIG. 3 as a perforated cover mounted on housing 22. Power line 32 in FIG. 1 enters shell 13 at 32*a* and has one line connected to connection 40, a hot wire connected to point 10, and a common connected to point 11**.

A network 20 including resistance and capacitance is connected in series between the one electrode 12 and the first terminal 10. In the illustrated example, the network includes resistance $R_2$ and capacitance $C_1$ connected in series, and by-pass resistance $R_1$ connected in parallel across the elements $R_2$ and $C_1$.

A filament **17*a* of electric lamp 17, and a gate controlled switch 18 are also connected in series between the terminals 10 and 11. Switch 18 may advantageously comprise a triac, as shown. Further, the network 20 is connected with the gate 18*a* of the first switch 18 to effect turn-on of switch 18 in response to predetermined charging of the capacitance $C_1$, to predetermined voltage level. Triac 18 is triggered into conduction in either direction when a voltage pulse of either polarity is applied to its gate electrode. A bidirectionally conductive device such as the diac 30 is connected between junction 31 and gate 18*a***. The diac is a voltage sensitive diode and breaks down and conducts current in either one or two directions when the voltage across it rises to a predetermined level. When the applied voltage difference falls below a predetermined holding level, the diac reassumes its blocking condition.

A second gate controlled switch 19 is shown as connected in series with the network 20, that switch also preferably comprising a triac, as shown. The electrode 12 is connected with the gate **19*a* of switch 19 to effect turn-on of switch 19 when current first passes between electrodes 12 and 13*c*, as via network 20, thereby to effect charging of capacitance $C_1$ to a voltage level which will turn on switch 18. When current flow stops between electrodes 12 and 13*c*, triac 19 turns off, and the charge on capacitor $C_1$ bleeds off via the resistance loop $R_1$ and $R_2$, switch 18 turns-off, and energization of lamp 17** ceases.

The lamp 17 typically includes a housing 22 which is hermetically sealed to protect filament **17*a*. The lamp is received in space 14 formed by a metallic shell 13 which is typically received in a niche in a swimming pool wall 24, and grounded at 15 (to metal work of the pool). Space 14 is filled with pool water, between the housing and shell, cooling the housing. Resistance $R_3$ connected in series with electrode 12 limits the amount of current which may flow to the electrode 13*c*** to a low, safe level.

In operation, when the light is pulled from the water and/or the water level drops below the top of the light, the circuit is opened thereby shutting off the power to the light. When the light is fully submerged, the circuit is closed via water conductivity between the two electrodes, the switch 19 is turned ON allowing the capacitor $C_1$ to charge to a voltage level which turns switch 18 ON. Extended life of the bulb filament 17*a* is achieved, since when power is applied to the circuit, a voltage drop occurs across triac 18, thus reducing the voltage applied to the bulb filament 17*a*. This voltage reduction results in extended life of the bulb. Items 18 and 30 may be separate or integral.

Typical values for circuit components are as follows:

$C_1$—0.047 μf, 200 V $R_1$—33,000 Ω, ½ Watt $R_2$—10,000 Ω, 5 Watt $R_3$—20,000 Ω, ½ Watt Triac 18—Q 2008 LT Triac 19—L 2000 LT (ECC Corp., Euless, Texas)

I claim:

1. In an underwater light circuit, the combination comprising (a) first and second terminals across which AC power is applicable, and a ground connection, (b) a pair of electrodes exposed for contact with the water, one electrode electrically connected with the first of said terminals, and the other electrode connection with said ground connection, (c) a network including resistance and capacitance connected in series between said one electrode and said first terminal, (d) an electric lamp having a filament, and a first gate controlled switch connected in series with the filament between said first and second terminals, (e) said network electrically connected with the gate of said first switch to effect turn-on of said first switch in response to predetermined charging of said capacitance to predetermined voltage level, (f) and a second gate controlled switch connected in series with said network, said one electrode connected with the gate of said second switch to effect turn-on of said second switch when current passes between said electrodes, thereby to effect current flow between said terminals and charging of said capacitance to said voltage level.

2. The combination of claim 1 wherein said first switch comprises a triac.

3. The combination of claim 1 wherein said second switch comprises a triac.

4. The combination of claim 1 wherein said network includes resistance and capacitance connected in series, said gate of the first switch connected to said network at a junction between said series connected resistance and capacitance, and by-pass resistance connected in parallel across said series connected resistance and capacitance.

5. The combination of claim 1 wherein the lamp includes a housing, and including a protective metallic shell forming a space into which said housing is received, the shell being grounded, said space adapted to receive water between the housing and shell.

6. The combination of claim 5 including resistance connected in series between said one electrode and said gate of the second switch.

7. The combination of claim 4 including a diac connected between said junction and said gate of the first switch.

8. The combination of claim 5 wherein said second electrode comprises a perforated metallic cover through which water may pass to contact the first electrode.

9. The combination of claim 8 wherein said cover is mounted on said housing.

* * * * *